US008640894B1

(12) United States Patent
Cronin

(10) Patent No.: US 8,640,894 B1
(45) Date of Patent: Feb. 4, 2014

(54) OUTDOOR TABLE ORGANIZER ASSEMBLY

(76) Inventor: Timothy Cronin, Millstone, NJ (US)

( * ) Notice: Subject to any disclaimer, the term of this patent is extended or adjusted under 35 U.S.C. 154(b) by 0 days.

(21) Appl. No.: 13/484,546

(22) Filed: May 31, 2012

(51) Int. Cl.

| | |
|---|---|
| ***A47B 43/00*** | (2006.01) |
| *A47F 3/14* | (2006.01) |
| *A47B 85/00* | (2006.01) |
| *A47B 37/00* | (2006.01) |
| *A47B 47/00* | (2006.01) |

(52) U.S. Cl.
USPC ..... 211/205; 211/133.4; 108/50.12; 108/23; 108/183

(58) Field of Classification Search
USPC ..... 403/361; 108/185, 50.13, 23, 183, 97; 248/225.11; 211/107, 196, 205, 133.4, 211/163, 133.1, 128.1, 126.2
See application file for complete search history.

(56) References Cited

U.S. PATENT DOCUMENTS

| | | | | |
|---|---|---|---|---|
| 1,166,815 | A * | 1/1916 | Cook | 242/140 |
| 2,971,701 | A * | 2/1961 | Shames et al. | 239/587.4 |
| 3,194,403 | A * | 7/1965 | Van Horn, Jr. | 211/78 |
| 3,624,732 | A * | 11/1971 | Bowden | 108/50.12 |
| 4,010,698 | A * | 3/1977 | Taub | 108/183 |
| D306,809 | S * | 3/1990 | Joseph | D6/521 |
| 5,335,803 | A | 8/1994 | O'Brien et al. | |
| 5,493,976 | A | 2/1996 | Hammond | |
| 5,522,514 | A | 6/1996 | Robinson | |
| D453,263 | S | 2/2002 | Wogan | |
| 6,736,358 | B2 | 5/2004 | Johnson | |
| 7,007,813 | B2 | 3/2006 | Yang | |
| 7,789,459 | B1 | 9/2010 | Rodriguez et al. | |
| 2004/0245423 | A1 | 12/2004 | Harned | |
| 2006/0011787 | A1 * | 1/2006 | Law | 248/121 |
| 2006/0065613 | A1 * | 3/2006 | McKay | 211/85.2 |
| 2008/0134551 | A1 | 6/2008 | Conforti et al. | |
| 2008/0266844 | A1 * | 10/2008 | Reynolds et al. | 362/147 |
| 2011/0094980 | A1 * | 4/2011 | Cousin et al. | 211/59.2 |

* cited by examiner

*Primary Examiner* — Jonathan Liu
*Assistant Examiner* — James Twomey

(57) ABSTRACT

An outdoor table organizer assembly is provided for storing multiple items commonly used in association with an outdoor table in an organized and easily accessible manner. The assembly includes an elongated pole inserted through an outdoor table. A utensil holder has a bottom and a perimeter wall extending upwardly from an outer edge of the bottom. The bottom further has an inner edge defining a hole. The pole is inserted through the hole in the bottom of the utensil holder frictionally coupling the pole to the utensil holder. A napkin holder is coupled to the perimeter wall of the utensil holder for holding napkins and a platform is coupled to and extends outwardly from the utensil holder. A post extends upwardly from the platform for supporting a roll of paper towels when the post is inserted into the roll of paper towels.

18 Claims, 5 Drawing Sheets

OUTDOOR TABLE ORGANIZER ASSEMBLY

BACKGROUND OF THE DISCLOSURE

Field of the Disclosure

The disclosure relates to table organizer devices and more particularly pertains to a new table organizer device for storing multiple items commonly used in association with an outdoor table in an organized and easily accessible manner.

SUMMARY OF THE DISCLOSURE

An embodiment of the disclosure meets the needs presented above by generally comprising an elongated pole inserted through an outdoor table. A utensil holder has a bottom and a perimeter wall extending upwardly from an outer edge of the bottom. The bottom further has an inner edge defining a hole. The pole is inserted through the hole in the bottom of the utensil holder frictionally coupling the pole to the utensil holder. A napkin holder is coupled to the perimeter wall of the utensil holder for holding napkins and a platform is coupled to and extends outwardly from the utensil holder. A post extends upwardly from the platform for supporting a roll of paper towels when the post is inserted into the roll of paper towels.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
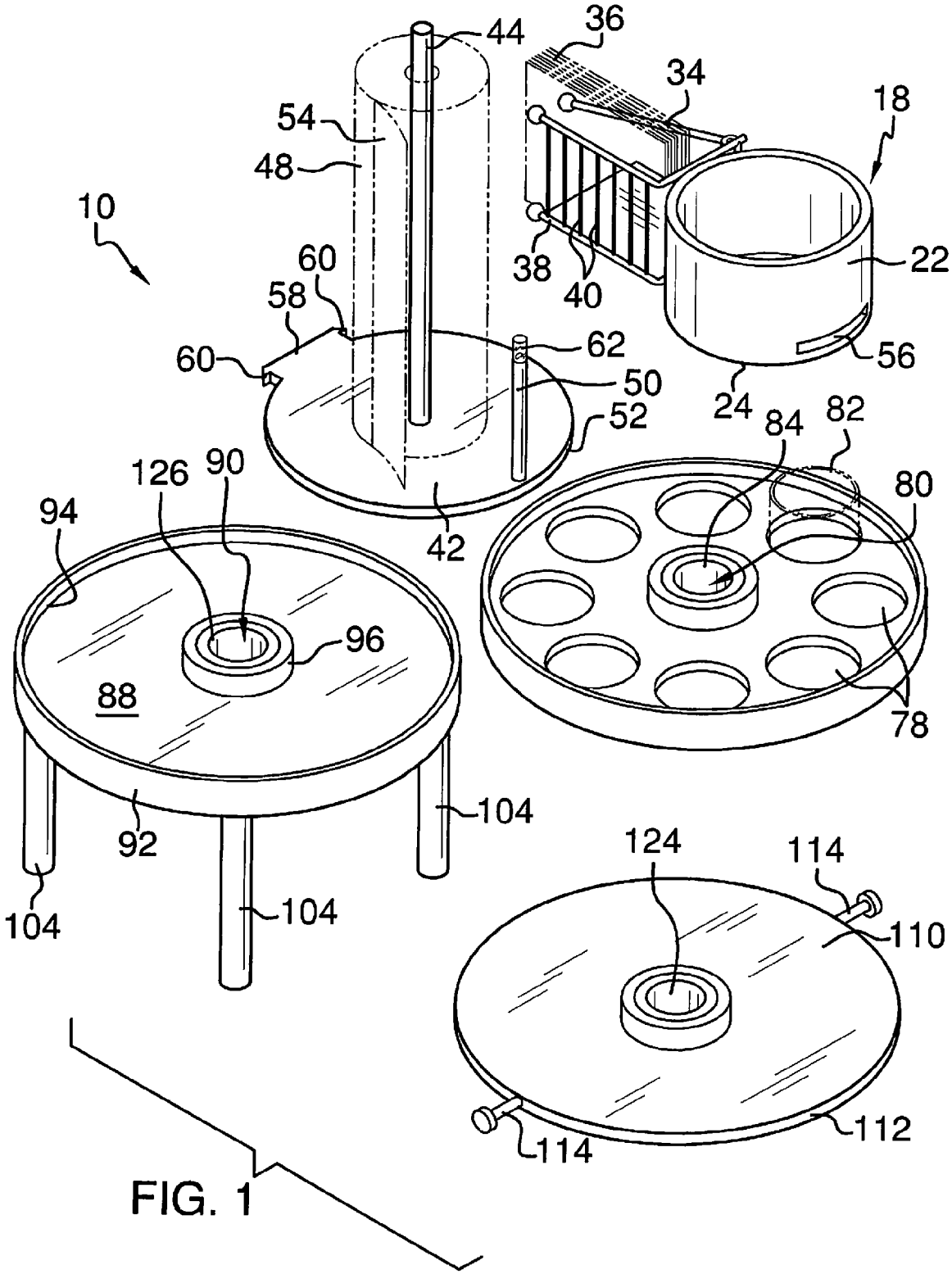
FIG. 1 is a top front side perspective view of a outdoor table organizer assembly according to an embodiment of the disclosure.
Figure 2:
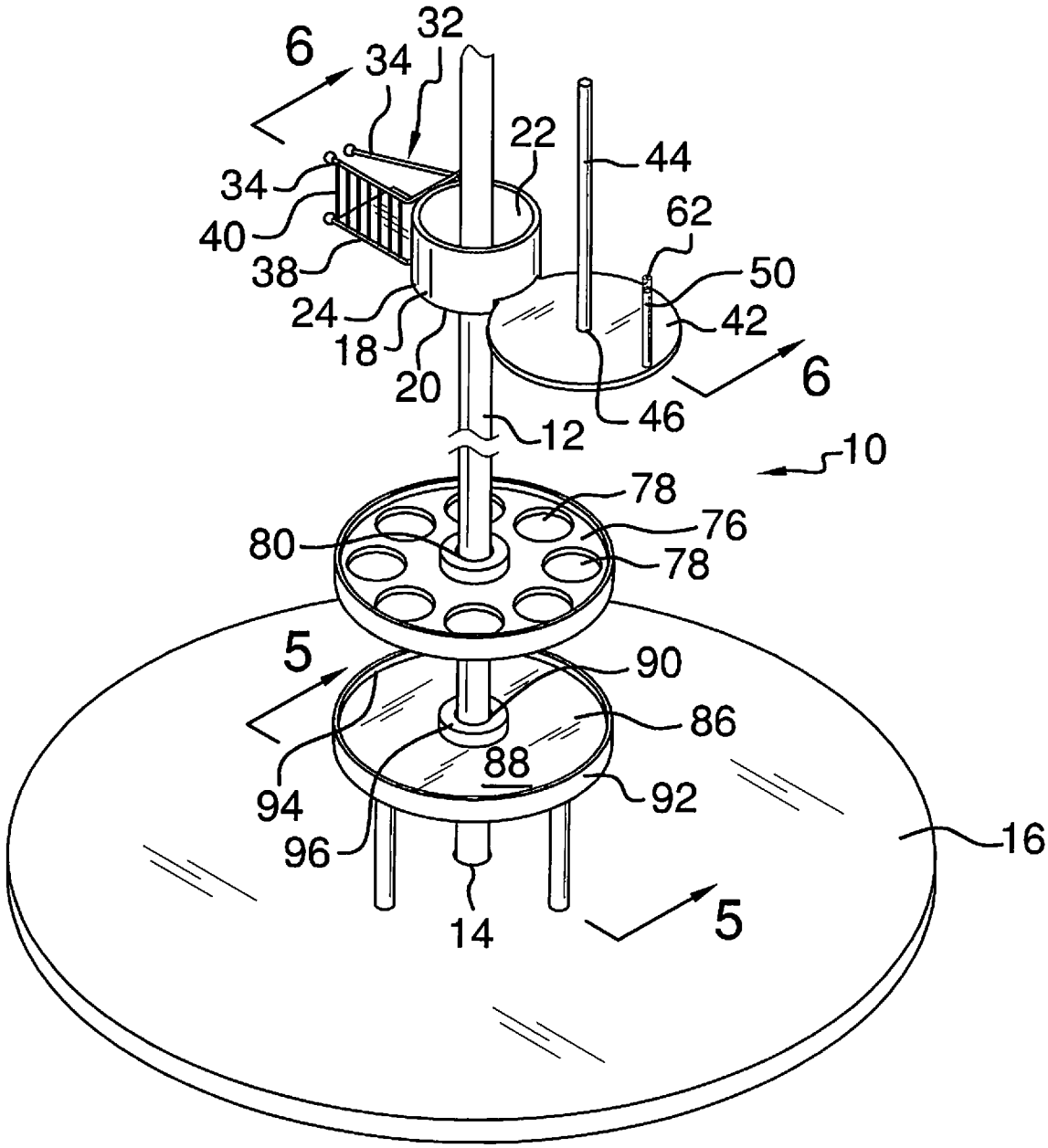
FIG. 2 is a top front side perspective view of an embodiment of the disclosure.
Figure 3:
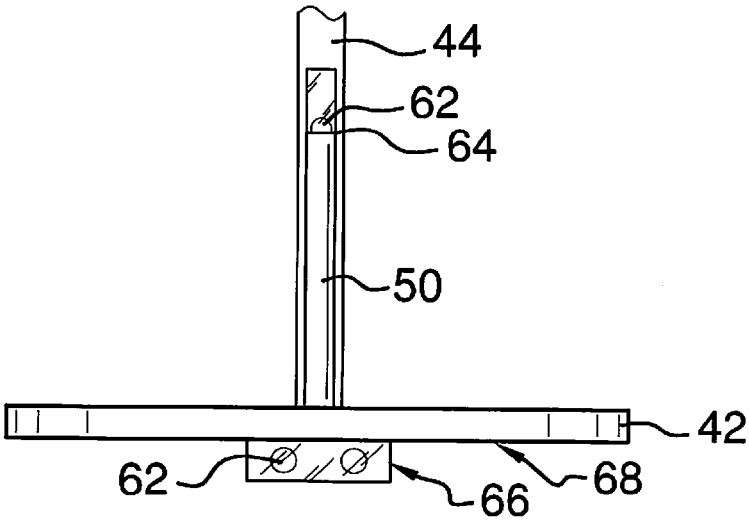
FIG. 3 is a front view of an embodiment of the disclosure.
Figure 4:
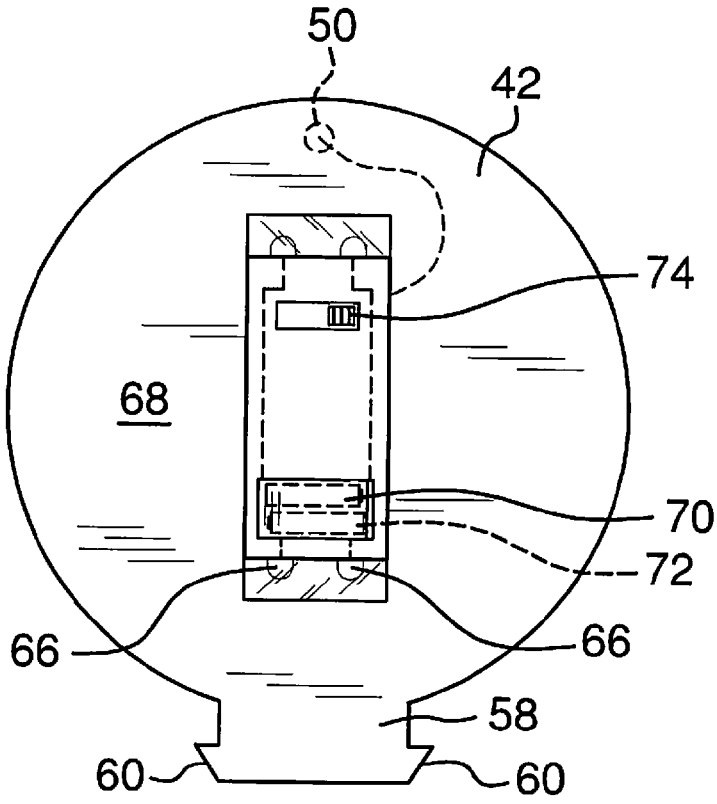
FIG. 4 is a bottom view of an embodiment of the disclosure.
Figure 5:
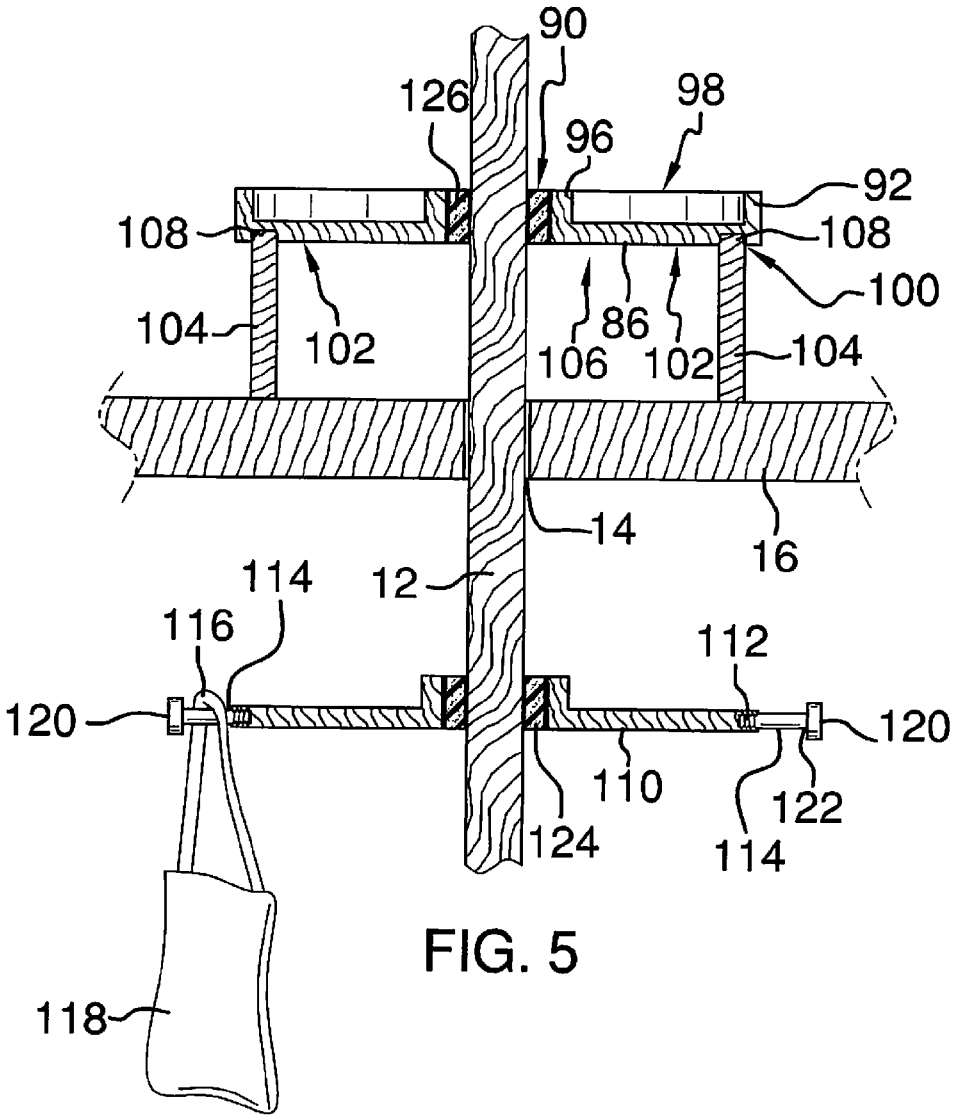
FIG. 5 is a cross-sectional view of an embodiment of the disclosure taken along line 5-5 of FIG. 2.
Figure 6:
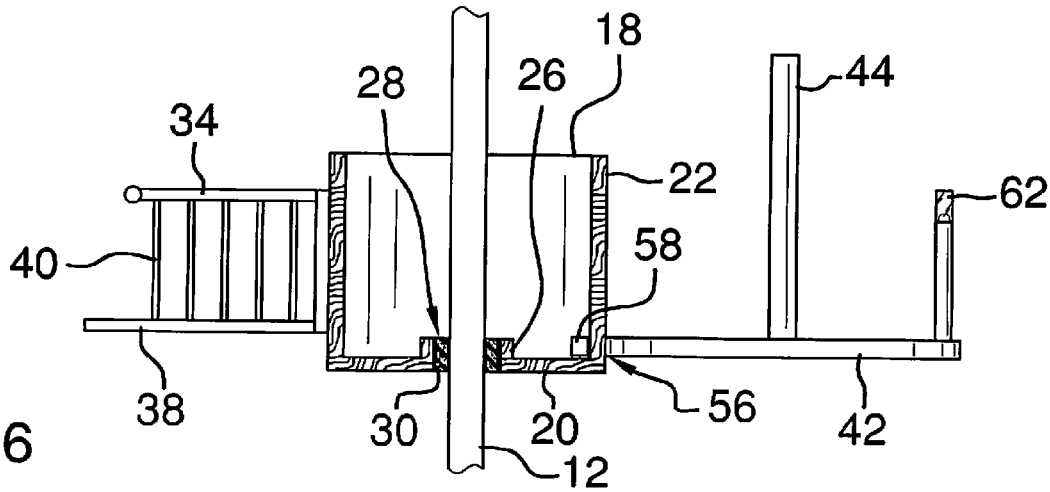
FIG. 6 is a cross-sectional view of an embodiment of the disclosure taken along line 6-6 of FIG. 2.

With reference now to the drawings, and in particular to FIGS. 1 through 7 thereof, a new table organizer device embodying the principles and concepts of an embodiment of the disclosure and generally designated by the reference numeral 10 will be described.

As best illustrated in FIGS. 1 through 7, the outdoor table organizer assembly 10 generally comprises an elongated pole 12 configured for insertion through a middle 14 of an outdoor table 16 such that the pole 12 is positioned vertically. The pole 12 may be part of an umbrella to provide shade for the table 16. A utensil holder 18 has a bottom 20 and a perimeter wall 22 extending upwardly from an outer edge 24 of the bottom 20. The bottom 20 has an inner edge 26 defining a hole 28. The pole 12 is inserted through the hole 28 in the bottom 20 of the utensil holder 18. The bottom 20 is frictionally coupled to the pole 12. A utensil holder gasket 30 may be coupled to the inner edge 26 of the bottom 20 of the utensil holder 18 frictionally engaging the pole 12 to facilitate retention of the utensil holder 18 in a desired position. The utensil holder gasket 30 may be constructed of rubber or another compressible material to enhance stable frictional support of the utensil holder 18 while permitting a user to selectively re-position the utensil holder 18 on the pole 12 as desired.

A napkin holder 32 is coupled to and extends outwardly from the perimeter wall 22 of the utensil holder 18. The napkin holder 32 may have opposed upper prongs 34 configured for pinching and holding a plurality of napkins 36. The napkin holder 32 may also have a lower support shelf 38 with a plurality of vertical members 40 extending between one of the upper prongs 34 and the lower support shelf 38.

A platform 42 is coupled to and extends outwardly from the utensil holder 18. A post 44 extends upwardly from a center 46 of the platform 42 whereby the platform 42 is configured for supporting a roll of paper towels 48 on the platform 42 when the post 44 is inserted into the roll of paper towels 48. A pin 50 may be coupled to and extend upwardly from the platform 42. The pin 50 is positioned proximate an outer edge 52 of the platform 42 in spaced relationship to the post 44. Thus, the pin 50 is configured for facilitating tearing a paper towel 54 from the roll of paper towels 48. A slot 56 is positioned in the perimeter wall 22 of the utensil holder 18. The slot 56 is positioned proximate the bottom 20 of the utensil holder 18. A tongue 58 is coupled to and extends from the platform 42. The tongue 58 is insertable into the slot 56 whereby the platform 42 is coupled to the utensil holder 18. The tongue 58 may have a pair of opposed barbed ends 60 engaging the utensil holder 18 facilitating retention of the tongue 58 in the slot 56.

A pin light 62 may be coupled to a distal end 64 of the pin 50 relative to the platform 42. A table light 66 may be coupled to a bottom surface 68 of the platform 42 for illuminating the table 16 positioned below the platform 42. The table light 66 may be incorporated into a housing 68 having a battery compartment 70 holding batteries 72. The pin light 62 may be electrically coupled to the batteries 72. An on/off switch 74 may be operationally coupled between the batteries 72 and the table light 66 and pin light 62.

A cup holder 76 may be coupled to the pole 12. The cup holder 76 includes a plurality of outer apertures 78 arranged around a central aperture 80. The central aperture 80 receives the pole 12 therethrough. Each outer aperture 78 is configured for receiving and holding a cup 82 in a stable position. A cup holder gasket 84 may be coupled to the cup holder 76 frictionally engaging the pole 12 in similar fashion to the utensil holder gasket 30.

A tray 86 may be coupled to the pole 12. The tray 86 has a planar upper surface 88 and an opening 90 extending through the tray 86. The opening 90 receives the pole 12 and a tray gasket 126 may be coupled to the tray 86 frictionally engaging the pole 12. An outer lip 92 is coupled to and extends upwardly from an outer edge 94 of the tray 86. An inner lip 96 may also be coupled to and extend upwardly from the tray 86. The inner lip 96 extends around the opening 90. The inner lip 96, the outer lip 92 and the upper surface 88 define a channel 98 extending around the tray 86. A plurality of cavities 100 may be positioned in a bottom surface 102 of the tray 86. A plurality of legs 104 may then be coupled to and extend downwardly from a bottom 106 of the tray 86. The legs 104 are configured for abutting the table 16 and supporting the tray 86 in spaced relationship above the table 16. Each leg 104 has an upper end 108 inserted into and frictionally engaging an associated one of the cavities 100.

A bag holder 110 may be coupled to the pole 12 in a position beneath the table 16. The bag holder 110 receives the pole 12. A bag holder gasket 124 may be coupled to the bag holder 110 frictionally engaging the pole 12. The bag holder 110 may be round and have an outer edge 112. A plurality of pegs 114 are coupled to and extend outwardly from the outer edge 112 of the bag holder 110. Each peg 114 is configured for insertion through a handle 116 of a bag 118 whereby the bag 118 is supported by and coupled to the bag holder 110. Each peg 114 has a head portion 120 positioned on a distal end 122 of the peg 114 relative to the outer edge 112 of the bag holder 110 to prevent the bag 118 from sliding off of the peg 114.

Figure 7:
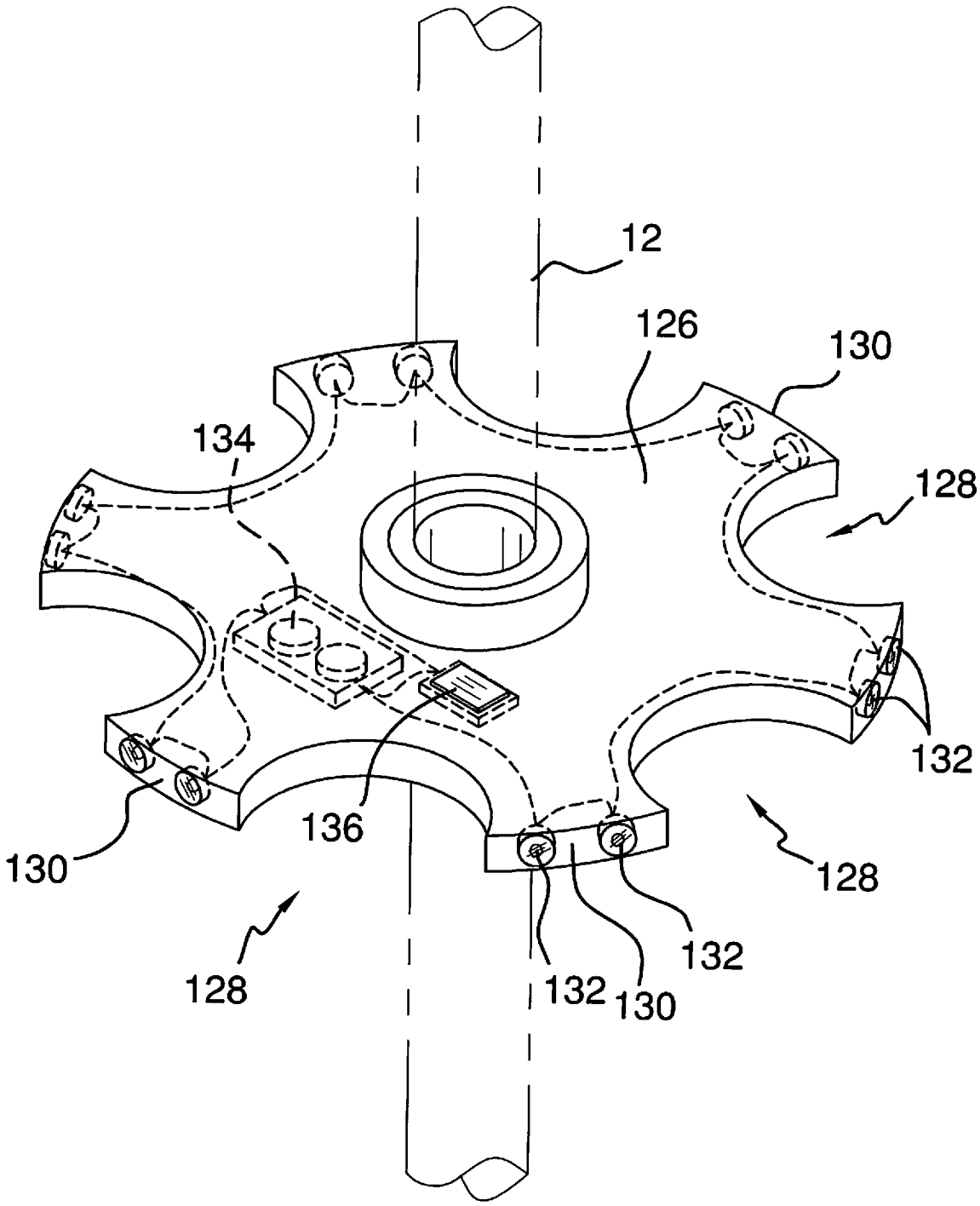
FIG. 7 is a top front side perspective view of an embodiment of the disclosure.

As shown in FIG. 7, a wine glass holder 126 may be coupled to the pole 12. The wine glass holder 126 includes a plurality of radially arranged cutouts 128 extending inwardly from an arcuate outer edge 130 of the wine glass holder 126. Each cutout 128 is configured to support and hold the bowl of a wine glass. The wine glass holder 126 may also incorporate a plurality of lights 132 coupled to the wine glass holder 126 and arranged in pairs along the arcuate outer edge 130 positioned between adjacent cutouts 128. A power source 134 may be coupled to an underside of the wine glass holder 126 and electrically coupled to each of the lights 132. An on/off switch 136 is coupled to the wine glass holder 126, positioned on a top surface 138 of the wine glass holder 126, and electrically coupled between the power source 134 and each of the lights 132.

In use, the utensil holder 18, the cup holder 76, the tray 86, and bag holder 110 may each be attached to the pole 12. Each may then be utilized to organize and store items prior to and during dining at the table 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An outdoor table organizer assembly comprising:

an elongated pole configured for insertion through a middle of an outdoor table whereby said pole is positioned vertically;

a utensil holder having a bottom and a perimeter wall extending upwardly from an outer edge of said bottom, said bottom having an inner edge defining a hole, said pole being inserted through said hole in said bottom of said utensil holder, said bottom being frictionally coupled to said pole, said bottom being planar and having said outer edge being laterally spaced from said inner edge, said bottom having a top side and a bottom side, said perimeter wall extending upwardly from said top side;

a napkin holder coupled to and extending outwardly from said perimeter wall of said utensil holder, said napkin holder being configured for holding a plurality of napkins;

a platform coupled to and extending outwardly from said utensil holder; and a post extending upwardly from said platform whereby said platform is configured for supporting a roll of paper towels when said post is inserted into the roll of paper towels;

a pin coupled to and extending upwardly from said platform, said pin being positioned proximate an outer edge of said platform in spaced relationship to said post whereby said pin is configured for facilitating tearing a paper towel from the roll of paper towels, and further including a pin light coupled to a distal end of said pin relative to said platform.

2. The assembly of claim 1, further comprising:

a slot positioned in said perimeter wall of said utensil holder, said slot being positioned proximate said bottom of said utensil holder; and a tongue coupled to and extending from said platform, said tongue being insertable into said slot whereby said platform is coupled to said utensil holder.

3. The assembly of claim 2, further including said tongue having a pair of opposed barbed ends engaging said utensil holder facilitating retention of said tongue in said slot.

4. The assembly of claim 1, further including a table light coupled to a bottom surface of said platform whereby said table light is configured for illuminating a table positioned below said platform.

5. The assembly of claim 1, further including a cup holder coupled to said pole, said cup holder having a plurality of outer apertures arranged around a central aperture receiving said pole therethrough, each outer aperture being configured for receiving and holding a cup.

6. The assembly of claim 1, further including a tray coupled to said pole, said tray having a planar upper surface and an opening extending through said tray, said opening receiving said pole therethrough.

7. The assembly of claim 6, further including an outer lip coupled to and extending upwardly from an outer edge of said tray.

8. The assembly of claim 7, further including an inner lip coupled to and extending upwardly from said tray, said inner lip extending around said opening, said inner lip, said outer lip and said upper surface defining a channel extending around said tray.

9. The assembly of claim 6, further including a plurality of legs coupled to and extending downwardly from a bottom of said tray, said legs being configured for abutting the table and supporting said tray in spaced relationship above the table.

10. The assembly of claim 9, further comprising:

a plurality of cavities positioned in a bottom surface of said tray; and each leg having an upper end inserted into and frictionally engaging an associated one of said cavities.

11. The assembly of claim 1, further comprising:

a bag holder coupled to said pole, said bag holder receiving said pole therethrough, said bag holder having an outer edge; and a plurality of pegs coupled to and extending outwardly from said outer edge of said bag holder, each said peg being configured insertion through a handle of a bag whereby the bag is supported by and coupled to said bag holder.

12. The assembly of claim 11, further including each said peg having a head portion positioned on a distal end of said peg relative to said bag holder.

13. The assembly of claim 1, further including a utensil holder gasket coupled to said inner edge of said bottom of said utensil holder, said utensil holder gasket frictionally engaging said pole.

14. The assembly of claim 5, further including a cup holder gasket coupled to said cup holder, said cup holder gasket frictionally engaging said pole.

15. The assembly of claim 6, further including a tray gasket coupled to said tray, said tray gasket frictionally engaging said pole.

16. The assembly of claim 11, further including a bag holder gasket coupled to said bag holder, said bag holder gasket frictionally engaging said pole.

17. An outdoor table organizer assembly comprising:

an elongated pole configured for insertion through a middle of an outdoor table whereby said pole is positioned vertically;

a utensil holder having a bottom and a perimeter wall extending upwardly from an outer edge of said bottom, said bottom having an inner edge defining a hole, said pole being inserted through said hole in said bottom of said utensil holder, said bottom being frictionally coupled to said pole;

a napkin holder coupled to and extending outwardly from said perimeter wall of said utensil holder, said napkin holder being configured for holding a plurality of napkins;

a platform coupled to and extending outwardly from said utensil holder;

a post extending upwardly from said platform whereby said platform is configured for supporting a roll of paper towels when said post is inserted into the roll of paper towels;

a pin coupled to and extending upwardly from said platform, said pin being positioned proximate an outer edge of said platform in spaced relationship to said post whereby said pin is configured for facilitating tearing a paper towel from the roll of paper towels;

a slot positioned in said perimeter wall of said utensil holder, said slot being positioned proximate said bottom of said utensil holder;

a tongue coupled to and extending from said platform, said tongue being insertable into said slot whereby said platform is coupled to said utensil holder, said tongue having a pair of opposed barbed ends engaging said utensil holder facilitating retention of said tongue in said slot;

a pin light coupled to a distal end of said pin relative to said platform;

a table light coupled to a bottom surface of said platform whereby said table light is configured for illuminating a table positioned below said platform;

a cup holder coupled to said pole, said cup holder having a plurality of outer apertures arranged around a central aperture receiving said pole therethrough, each outer aperture being configured for receiving and holding a cup;

a tray coupled to said pole, said tray having a planar upper surface and an opening extending through said tray, said opening receiving said pole therethrough;

an outer lip coupled to and extending upwardly from an outer edge of said tray;

an inner lip coupled to and extending upwardly from said tray, said inner lip extending around said opening, said inner lip, said outer lip and said upper surface defining a channel extending around said tray;

a plurality of cavities positioned in a bottom surface of said tray;

a plurality of legs coupled to and extending downwardly from a bottom of said tray, said legs being configured for abutting the table and supporting said tray in spaced relationship above the table, each leg having an upper end inserted into and frictionally engaging an associated one of said cavities;

a bag holder coupled to said pole, said bag holder receiving said pole therethrough, said bag holder having an outer edge;

a plurality of pegs coupled to and extending outwardly from said outer edge of said bag holder, each said peg being configured insertion through a handle of a bag whereby the bag is supported by and coupled to said bag holder, each said peg having a head portion positioned on a distal end of said peg relative to said bag holder;

a utensil holder gasket coupled to said inner edge of said bottom of said utensil holder, said utensil holder gasket frictionally engaging said pole;

a cup holder gasket coupled to said cup holder, said cup holder gasket frictionally engaging said pole;

a tray gasket coupled to said tray, said tray gasket frictionally engaging said pole; and a bag holder gasket coupled to said bag holder, said bag holder gasket frictionally engaging said pole.

18. The assembly of claim 1, wherein said napkin holder includes a pair of opposed upper prongs configured to pinch and hold a plurality of napkins.

* * * * *